United States Patent [19]

Tomasetti

[11] 4,090,446

[45] May 23, 1978

[54] CONTROLLED DEPTH OF BURIAL PENETRATOR

[75] Inventor: Thomas A. Tomasetti, Taylor, Pa.

[73] Assignee: The United States of America as represented by the Secretary of the Air Force, Washington, D.C.

[21] Appl. No.: 765,028

[22] Filed: Feb. 2, 1977

[51] Int. Cl.[2] ..... F42B 25/00

[52] U.S. Cl. ..... 102/7.2; 102/8

[58] Field of Search ..... 102/2, 7.2, 7.4, 8, 102/49.5, 52, 53, 56 R, 91

[56] References Cited

U.S. PATENT DOCUMENTS

| | | | |
|---|---|---|---|
| 2,338,322 | 1/1944 | Ferrer | 102/49.5 UX |
| 2,654,320 | 10/1953 | Schmid | 102/49.5 X |
| 3,282,214 | 11/1966 | Briscoe | 102/91 X |
| 3,528,530 | 9/1970 | Franck et al. | 102/53 |
| 3,774,540 | 11/1973 | Burford et al. | 102/2 |

*Primary Examiner*—David H. Brown

*Attorney, Agent, or Firm*—Joseph E. Rusz; Jacob N. Erlich

[57] ABSTRACT

A controlled depth of burial penetrator having a front and rear section. These sections are secured together with the leading edge or nose of the rear section being at approximately 45° with respect to a line drawn along the longitudinal axis of the penetrator. The front section contains a separating charge which at a predetermined time after impact separates the front and rear sections. Subsequently the rear section is thrust off in a direction different from said first section thereby effecting its controlled depth of penetration within the earth.

7 Claims, 5 Drawing Figures

10
20
22
24
40

CONTROLLED DEPTH OF BURIAL PENETRATOR

STATEMENT OF GOVERNMENT INTEREST

The invention described herein may be manufactured and used by or for the Government for governmental purposes without the payment of any royalty thereon.

BACKGROUND OF THE INVENTION

This invention relates generally to penetrators, and, more particularly, to a penetrator which includes therein an explosive warhead section and which is capable of a controlled depth of burial within the earth.

Munitions serve various functions during the defense or attack of a territory. One such munition is of the type which is utilized to defeat an earth-covered target. In such an application it is desirable to have a warhead penetrate the earth located around the target to a prescribed controllable depth before initiation of the explosive charge in the warhead.

Other uses for such a munition include the land mine application in which the explosive charge itself is to be hidden from the view of advancing enemy troops. This type of munition is placed, preferably, beneath the surface of the earth prior to enemy troop advancement and inflicts damage upon either personnel or equipment at a preselected time or upon activation thereof by the personnel or equipment. In some instances it is extremely difficult to place this munition underground since the hazards involved in reaching the desired destination for implanting of the munition beneath the surface of the earth are greater than those that may be encountered by direct confrontation with the enemy.

Heretofore the large problem involved was how to consistently bring a surface crating or land mine-type munition to rest at a proper depth of burial under a concrete surface or the like or in areas where the effectiveness of land mine-type munitions are essential.

SUMMARY OF THE INVENTION

The instant invention provides a dual stage kinetic energy penetrator which is designed to control its depth of burial into the soil and as a result thereof overcome the problems set forth in detail hereinabove.

The penetrator of this invention is made up of a penetrating section, an explosive separating charge, a warhead section having a wedge shaped nose design and a cratering explosive charge. The penetrator uses the combination of explosive impulse and a unique wedge-shaped nose design in order to cause the warhead section to perform an abrupt turn within the soil or earth, thereby limiting its depth of burial and bring it to rest within a preselected location. Because of the nose design, the turning and acceleration forces are such that depth of burial is relatively insensitive to impact velocity.

The penetrator of this invention is delivered to a preselected site either by aircraft or rocket launchers or the like and after entering the soil or earth, the warhead section is separated from the nose section by an initial separating charge. The wedge-shaped nose section follows a trajectory which limits its depth of burial and brings it to rest in a desired position where it may be detonated at some later time.

It is therefore an object of this invention to provide a penetrator which has a controlled depth of burial.

It is a further object of this invention to provide a controlled depth of burial penetrator which contains therein a warhead section for detonation at a preselected time or situation.

It is still a further object of this invention to provide a controlled depth of burial penetrator such that the depth of burial is relatively insensitive to impact velocity.

It is still another object of this invention to provide a controlled depth of burial penetrator which is economical to produce and which utilizes conventional, currently available components that lend themselves to standard mass producing manufacturing techniques.

For a better understanding of the present invention together with further objects thereof reference is now made to the following description taken in conjunction with the accompanying drawing and its scope will be pointed out in the appended claims.

DETAILED DESCRIPTION OF THE PREFERRED EMBODIMENT

Figure 1:
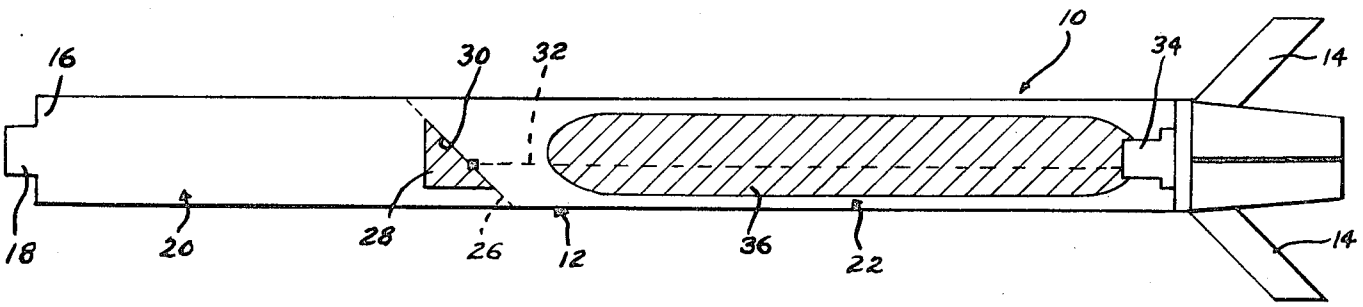
FIG. 1 is a side elevational schematic illustration of the controlled depth of burial penetrator of this invention.

Reference is now made to FIG. 1 of the drawing which best illustrates the penetrator 10 of this invention. Penetrator 10 is made of an elongated body 12 having a somewhat streamline configuration including a plurality of stabilizing fins 14 at rear thereof and a front section 16 made of an extremely hard material such as steel. Front section 16 of penetrator 10 may be of any suitable configuration capable of penetrating any hard surface such as concrete or the earth, and therefore may include thereon an extension 18.

Figure 2:
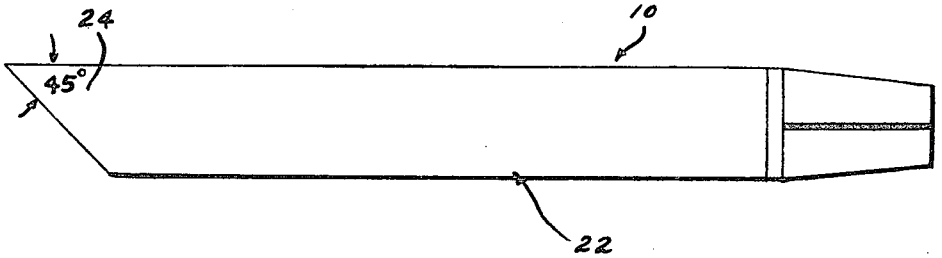
FIG. 2 is a side elevational schematic illustration of the warhead section of the penetrator of this invention.

Penetrator body 12 is generally made up of two sections, a forward or penetrating section 20 which includes front section 16 and a warhead section 22 which includes stabilizing fins 14. Warhead section 22, best shown in FIG. 2 of the drawing, has a wedge-shaped leading edge or nose 24. Nose 24 is preferably designed at 45° with respect to the longitudinal axis thereof to provide an optimum retarding force and turning movement to warhead section 22 in a manner to be described hereinbelow.

Warhead section 22 is secured to penetrating section 20 by any suitable securing method such as welding as shown at 26 in FIG. 1. A separating charge 28 having a substantially isosceles right triangular configuration is located within penetrating section 20 adjacent weld 26 or nose 24 of warhead section 22. By placing the hypotenuse of the triangular shaped separating charge 28 adjacent nose 24 insures a substantially 45° separation of penetrating section 20 and warhead section 22 upon detonation of separating chrge 28 to take place along weld 26. The separating charge 28 which may take the form of any suitable conventional explosive such as H-6, AFX 108 or AFX 109 explosive is detonated by the activation of an initiation train 32 operatively connected to any conventional fuze 34 located within warhead section 22.

Still referring to FIG. 1 of the drawing, warhead section 22 also contains therein any suitable cratering charge 36 in the form of a conventional explosive such as H-6, AFX 108 or AFX 109 explosive. Cratering charge 36 is also operatively connected to fuze 34 or to a separate fuze (not shown) for detonation thereof at a preselected time after separation of warhead section 22 from penetrating section 20. If desired, however, cratering charge 36 may also be activated by pressure thereon from above ground similar to a land mine.

Figures 3, 4, 5:
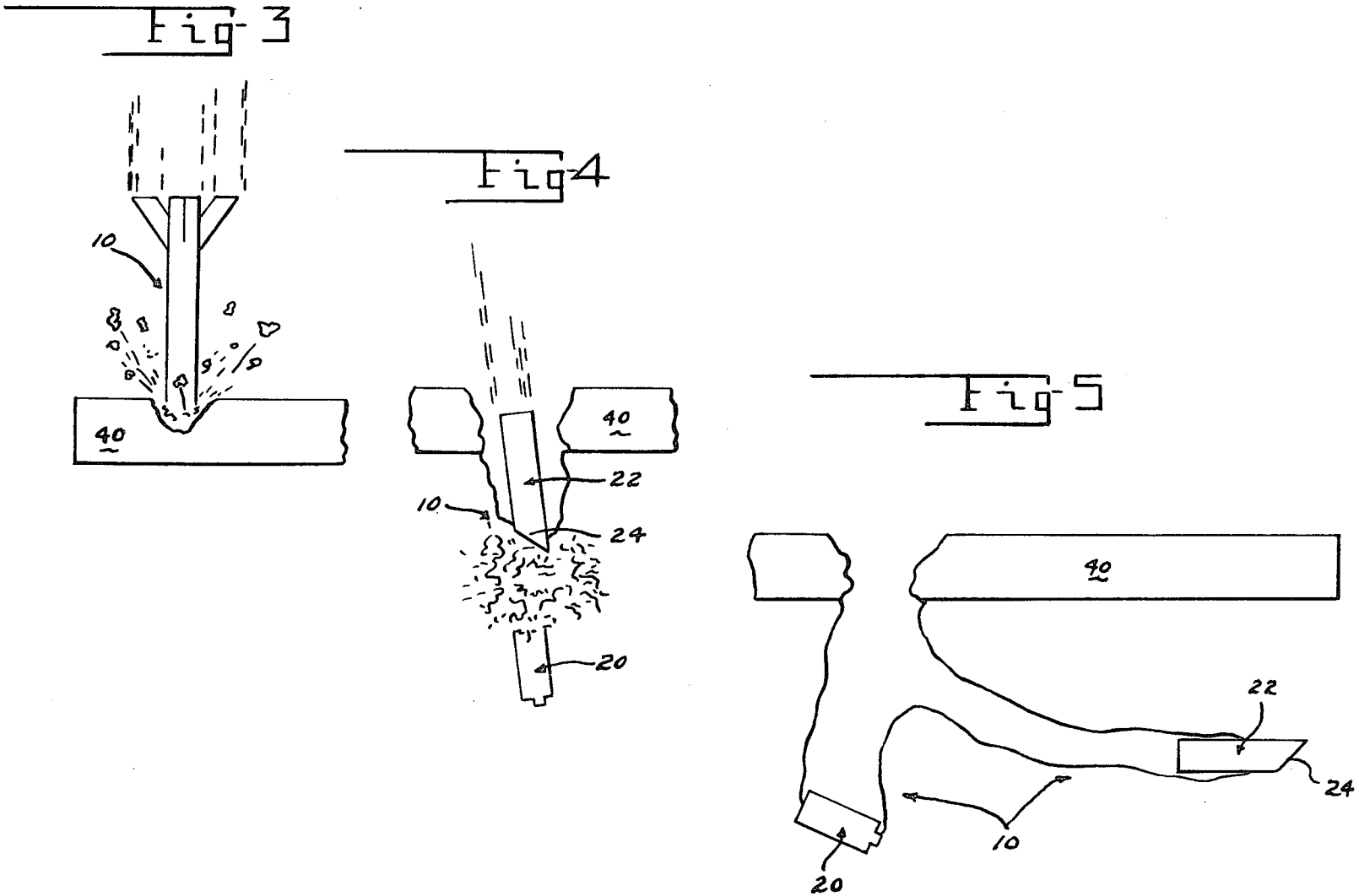
FIG. 3 is a pictorial illustration of the impact and entrance of the penetrator of this invention.
FIG. 4 is a pictorial illustration of the separation of the warhead section of the penetrator of this invention.
FIG. 5 is a pictorial illustration of the turning and subsequent rest of the warhead section of the penetrator of this invention beneath the earth surface.

As shown in FIGS. 3–5 of the drawing, upon launch from any conventional launching device, penetrator 10, as shown in FIG. 3, enters a concrete barrier or hard earth surface 40 at substantially right angles to the surface. At a predetermined depth or time after impact, as shown in FIG. 4, initiating of the separating charge 28 takes place and the penetrating section 20 of penetrator 10 separates from the warhead section 22. As a result of this separation, a 45° angular configurated nose 24 allows for the abrupt turning of warhead section 22 in the manner illustrated in FIG. 5 of the drawing. Upon the subsequent decreases of velocity of warhead section 22, warhead section 22 comes to rest in a desired position beneath the earth's surface. At a later time, detonation of warhead section 22 takes place under the influence of charge 36. This detonation will bring about the intended destructive force of penetrator 10 of this invention upon the object or objects situated thereabove.

Although this invention has been described with reference to a particular embodiment it will be understood to those skilled in the art that this invention is also capable of a variety of alternate embodiments within the spirit and scope of the appended claims.

I claim:

1. A controlled depth of burial penetrator comprising an elongated body of streamlined configuration, said body being made up of a first and second section, said second section having a nose thereon, said nose being of a wedge-shaped configuration defining an angle of substantially 45° with respect to a line located along the longitudinal axis of said penetrator, said sections being fixedly secured together whereby an end of said first section matingly engages said nose of said second section, and means located within said first section for separating said first section from said second section at a predetermined time, said means for separating said sections being in the form of an explosive charge having a substantially isoseceles right triangular configuration, the hypotenuse thereof located adjacent said nose of said second section, whereby said second section upon separation from said first section is capable of movement in a direction different from said first section.

2. A controlled depth of burial penetrator as defined in claim 1 wherein said first and second sections are fixedly secured together by a weld.

3. A controlled depth of burial penetrator as defined in claim 2 wherein said second section contains an explosive charge therein.

4. A controlled depth of burial penetrator as defined in claim 3 wherein the other end of said first section is made of an extremely hard material.

5. A controlled depth of burial penetrator as defined in claim 4 wherein said other end of said first section has an extension thereon, said extension being made of an extremely hard material.

6. A controlled depth of burial penetrator as defined in claim 5 wherein said second section has means located therein for activating said explosive charge in said first section and said explosive charge in said second section.

7. A controlled depth of burial penetrator as defined in claim 6 wherein said activating means is in the form of a fuze.

* * * * *